US007036399B1

(12) United States Patent
Gao et al.

(10) Patent No.: US 7,036,399 B1
(45) Date of Patent: May 2, 2006

(54) RATCHET SCREWDRIVER WITH ACTUATOR CAP AND METHOD

(75) Inventors: Hua Gao, Fox Point, WI (US); James A. Rinner, Racine, WI (US)

(73) Assignee: Pilling Weck Incorporated, Horsham, PA (US)

( * ) Notice: Subject to any disclaimer, the term of this patent is extended or adjusted under 35 U.S.C. 154(b) by 1 day.

(21) Appl. No.: 10/789,576

(22) Filed: Mar. 1, 2004

(51) Int. Cl.
*B25B 13/26* (2006.01)

(52) U.S. Cl. ..... 81/58.4; 81/63.1

(58) Field of Classification Search ..... 81/58.4, 81/63.1, 60, 59.1; 192/45.1, 54.2, 44, 45
See application file for complete search history.

(56) References Cited

U.S. PATENT DOCUMENTS 1,193,716 A 8/1916 Pursell
5,613,585 A 3/1997 Tiede
5,848,680 A * 12/1998 Rinner ..... 192/43.1
6,047,617 A * 4/2000 Chen ..... 81/63.1
6,082,226 A * 7/2000 Lin ..... 81/62
6,206,160 B1 3/2001 Chen
6,443,037 B1 9/2002 Chang
6,523,439 B1 2/2003 Huang
6,543,315 B1 * 4/2003 Huang ..... 81/62

* cited by examiner

*Primary Examiner*—Lee D. Wilson
(74) *Attorney, Agent, or Firm*—Baker Hostetler LLP

(57) ABSTRACT

A ratchet screwdriver having a base assembly including a handle and an insert, and having a cap rotatable on the base assembly, and there is pawl mechanism which is controlled by the cap. There is an intervening member in the form of a detent to serve as a stop for restricting the axial movement of the cap relative to the base assembly, so the cap cannot be removed from the base assembly until the detent is released. The detent, or other parts of the screwdriver, can serve as a rotation stop for the cap which has selective positions for setting the ratcheting position of the screwdriver.

30 Claims, 8 Drawing Sheets

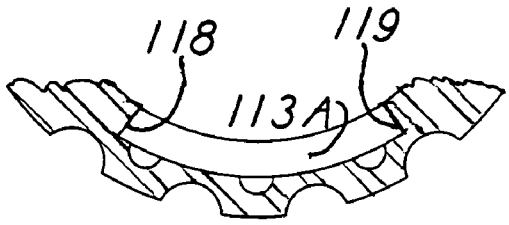
Fig. 34
Fig. 33
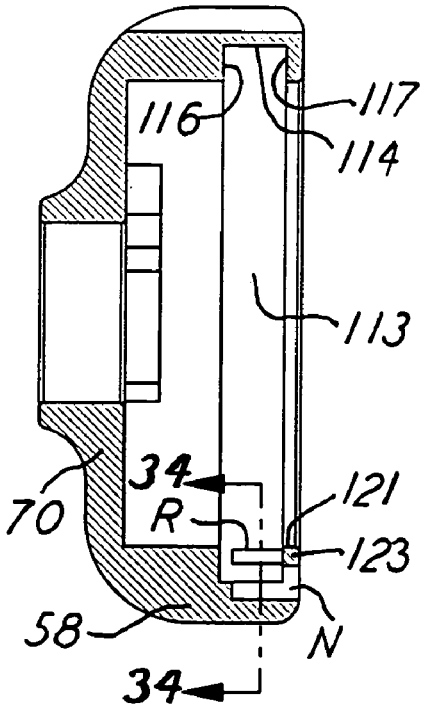
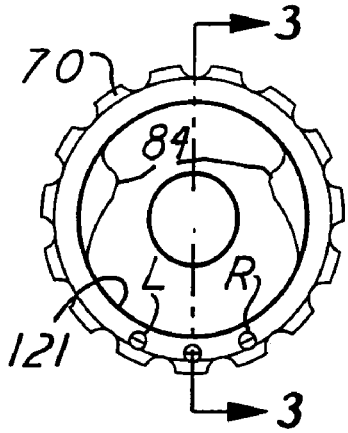
Fig. 32

RATCHET SCREWDRIVER WITH ACTUATOR CAP AND METHOD

This invention pertains to a ratchet screwdriver with an actuator cap and a method involving same. This screwdriver has a base assembly handle and a pawl mechanism for selectively driving a gear which is in driving relationship with a driving member operable on a workpiece. An actuator cap is rotatably mounted on the base assembly for controlling the position of the pawl mechanism and thereby control the direction of drive of the gear.

BACKGROUND OF THE INVENTION

Ratchet screwdrivers are commonly known in the prior art, and they have a handle with a control cap for positioning their pawls and thereby selectively establish the driving direction of the screwdriver. The mechanics of mounting and retaining the caps on the handles is a concern, and there are different arrangements for accomplishing that. Thus, the caps are mounted on the handles and are rotatable thereon in both clockwise directions for the selection of the direction of the drive. The desire is to have the cap rotatable, but through a limited amount of a full circle, and to have it releasably positionable in selected positions within the limited circle of its movement, for drive direction selection. Also, the mounting and removal of the cap relative to the handle is of concern.

The present invention addresses the above-mentioned concerns, and it does so with a sturdy and operably reliable arrangement. It provides for three functions of restraining the cap, those are in the axial direction, rotationally positioning the cap in selective operating positions, and limiting the cap against rotation. All three of these functions are achieved by mechanics and a method which is commercially desirable and which meets the strict demands of screwdrivers for use in the medical art. This screwdriver can be readily disassembled for cleaning repair or the like, and it is outstandingly sensitive to the user's desires of setting the cap in the selective positions for driving directions of operation.

Further, the screwdriver of this invention is arranged such that the cap can be readily and easily removed without special tools and without particular skill. A user of the screwdriver can remove the cap quickly and easily, and the cap is otherwise firmly on the base assembly and is stable thereon, and the cap is easily rotated for selecting the desired operative positions, and those selected positions are firmly retained until the next position is selected by the user. The methods of cap assembly, retention, positioning and removal are parts of this invention.

Other objects and advantages will become apparent upon reading the specification in light of the accompanying drawings.

BRIEF DESCRIPTION OF THE DRAWINGS

FIG. 32 is an end elevation view similar to FIG. 17.

FIG. 33 is an enlarged section view taken on a plane designated by the line 33—33 in FIG. 32.

FIG. 34 is a section view taken on a plane designated by the line 34—34 in FIG. 33.

DESCRIPTION OF THE EMBODIMENTS AND METHOD

Figures 1, 2, 3, 4, 5:
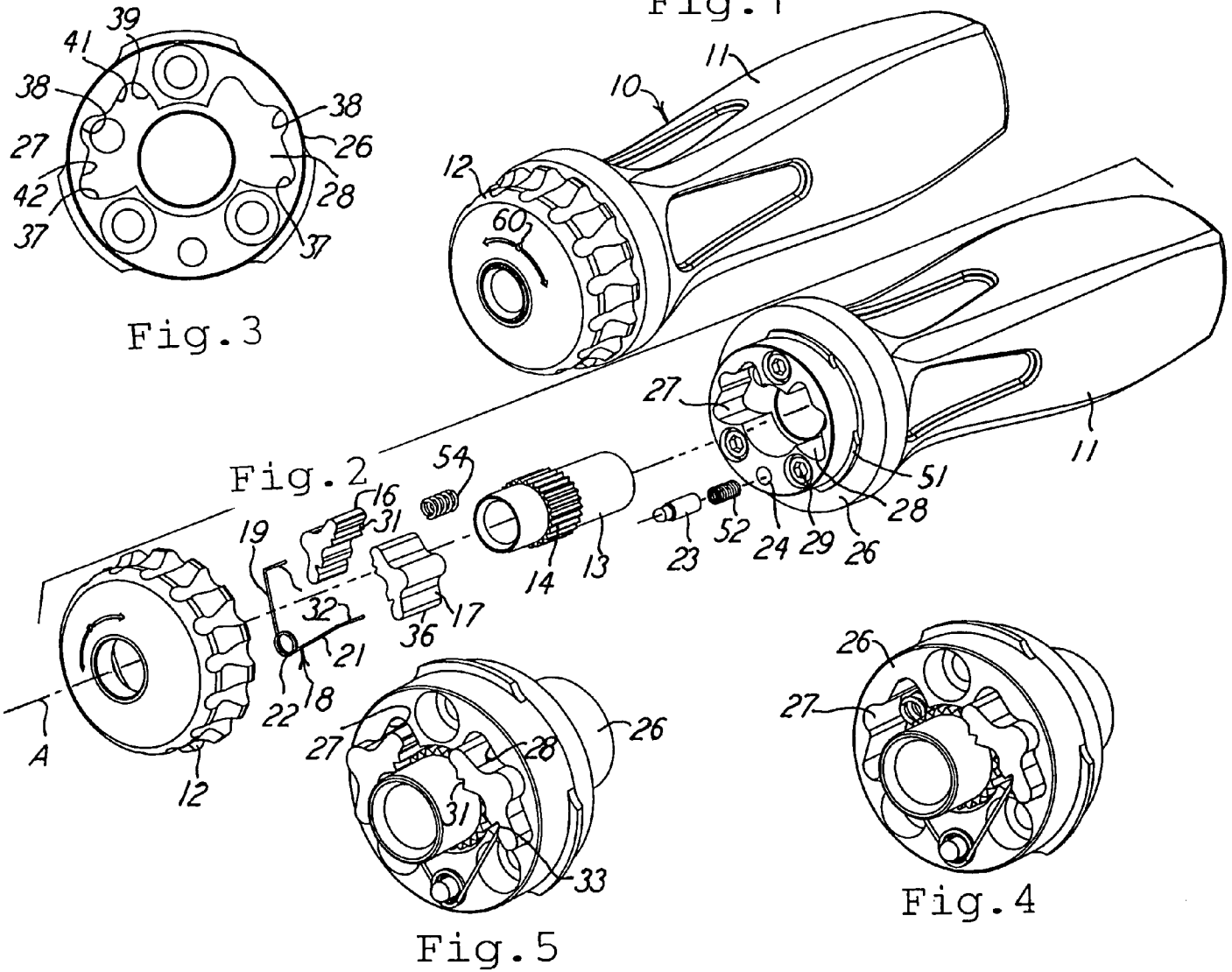
FIG. 1 is a front perspective view of one embodiment of the assembled driver of this invention.
FIG. 2 is an exploded view of the driver of FIG. 1.
FIG. 3. is a end elevation view of a handle part of FIG. 1.
FIG. 4 is a perspective view of a handle part of the assembly of FIG. 1.
FIG. 5 is a perspective view similar to FIG. 4 but with a pawl added thereto.

FIG. 1 shows the driver which incorporates this invention, and there is shown a screwdriver 10 having an elongated housing in the form of a handle 11 seen in FIGS. 1 and 2. FIG. 2 shows the screwdriver with the handle 11 and a cap 12, which serves as a pawl positioner, and the internal parts, all parts are oriented along the longitudinal axis A. There is a cylindrical gear member 13 which is snugly assembled with the handle 11 to be rotatable therein and it has gear teeth 14.

Figure 7:
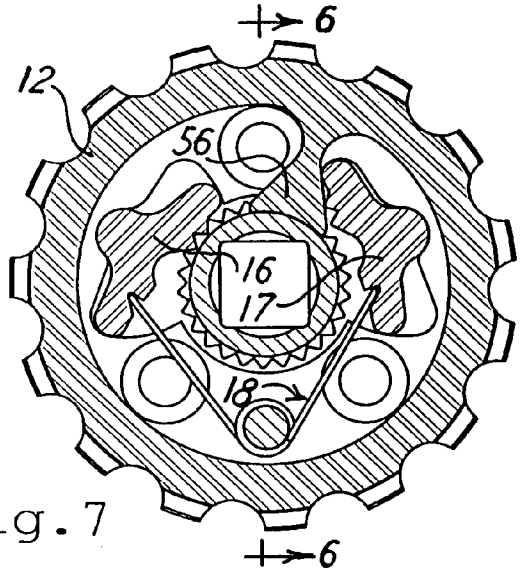
FIG. 7 is section view taken transverse of a view such as seen in FIG. 6 and substantially along a plane designated by a line 7—7 in FIG. 6, and showing one embodiment of the invention in the shown rotatable cap.
Figure 8:
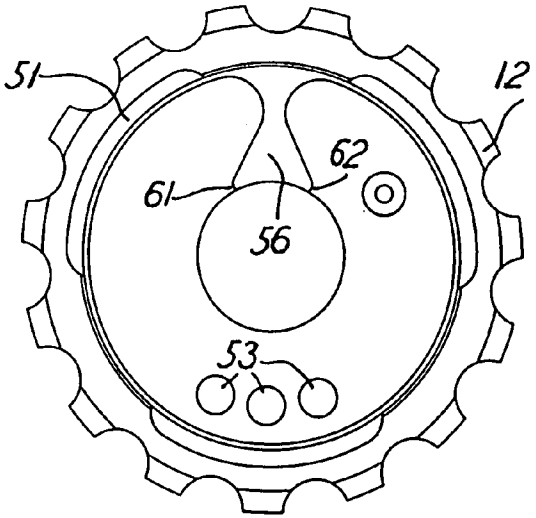
FIG. 8 is an end elevation view of a part seen in FIG. 7, but in a slightly different rotated position.
Figure 6:
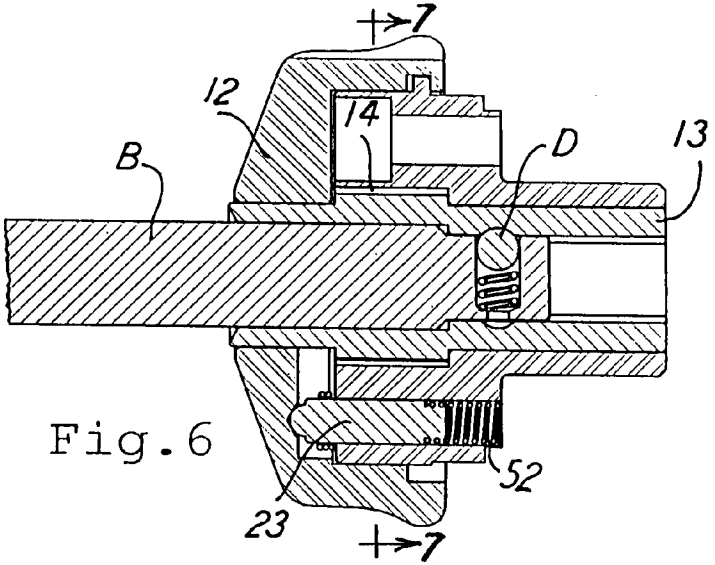
FIG. 6 is an enlarged section view, taken along the longitudinal axis, such as seen in FIG. 1, of parts of the assembly of FIG. 1, and with a fragment of a tool bit therein, and taken substantially alone the plane designated by the line 6—6 of FIG. 7.

As shown in FIGS. 6 and 7, a bit B, such as a conventional screwdriver bit, can be inserted into the member 13 to rotate therewith by having a square mating drive therewith and there can be a ball detent D to hold the bit B. Or there can be an unshown arrangement for engaging a screw, nut, bolt, or the like, to rotationally drive that work piece, as usual, with an unshown adapter.

FIG. 2 also shows two pawls 16 and 17 and a pawl spring 18 which is V-shaped and has two legs 19 and 21 extending from a central helical portion 22 which is piloted and supported on a post 23 suitable disposed in an insert hole 24 and thereby be supported by the housing 11.

Sheet one of the drawings shows that the handle 11 supports a cylindrically shaped insert 26 which is suitable affixed with the handle 11, such as by being pressed therein, and which has two specially shaped pockets 27 and 28 for respective reception of the two pawls 16 and 17. FIG. 3 shows the shapes of the two pockets 27 and 28 which are in mirror image, and they are shown to be disposed substantially to the upper half of that end view of FIG. 3, that is, they are offset to that upper half. Insert 26 can be affixed to the handle 11 with screws 29 extending through insert 26 and into the handle 11. In this description and the claims, the insert 26 is included in the reference to the word handle.

Figure 20:
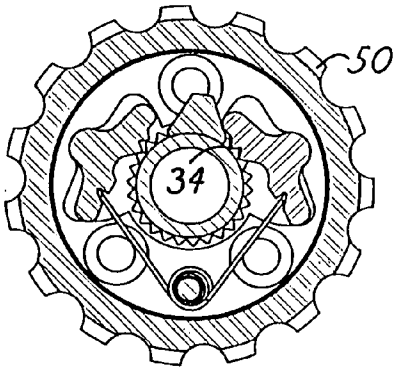
FIG. 20 is a section view of the can of FIG. 19 and taken similar to that of FIG. 7, but including parts added thereto.

FIGS. 4 and 5 also show how the pawls 16 and 17 are assembled relative to the driver and the spring 18 is mounted on the post 23 and in contact with the pawls 16 and 17. The pawls 16 and 17 have teeth 31 which can drivingly engage the gear teeth 14, such as shown in FIGS. 5 and 20, and the spring 18 yieldingly urges the pawls into their respective gear teeth engaged positions.

Figure 12:
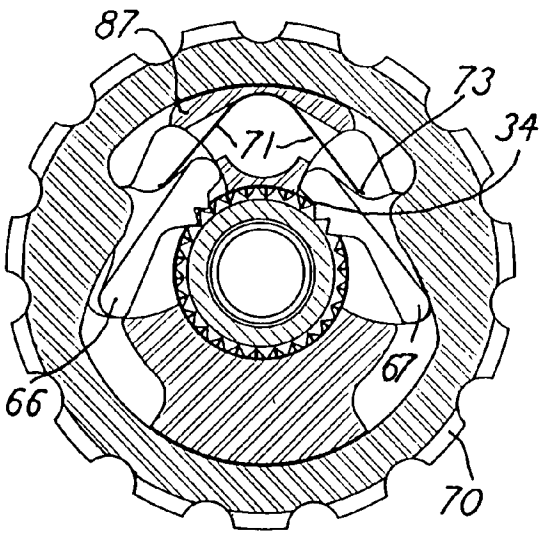
FIG. 12 is a section view taken similar to that of FIG. 7 and being of the embodiment of FIG. 11 with parts added thereto.
Figure 18:
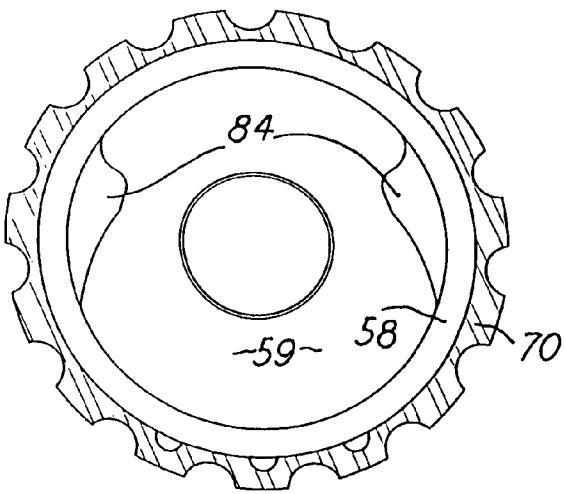
FIG. 18 is a section view of the cap of FIG. 17.

The spring 18 has two angled ends 32 which are received in slots 33 in each of the pawls 16 and 17, as seen in FIGS. 2, 5 and 7. The spring 18 is centrally coiled and presents extending ends 33 which are normally spring-urged away from each other and thereby urge radially outwardly on the pawls at their slots 33. The pawls 16 and 17 are pivotal into and out of tooth engagement with the gear teeth 14 under the urging of the spring 18 and another influence explained later herein. The pawls engage the gear teeth at the two respective locations designated 34 on the circumference of the gear teeth 14, as seen in FIGS. 12 and 20. It will also be seen that the pawls 16 and 17 extend along their axial length designation 36, in the direction of the axis A, substantially at the diameter of the gear teeth 14. Thus there is a substantial length of tooth contact between the gear teeth 14 and pawl teeth 31, and that length is substantially at the diameter of the tooth base circle of the gear teeth 14.

As seen in FIGS. 4 and 5, the teeth 31 of the pawls 16 and 17 extend beyond the axial extent of the gear teeth 14. Thus the pawls present an extension or overhang in their lengths, and, as explained later, there are two embodiments of webs or actuator surfaces which engage those overhangs for pivoting the pawls out of tooth engagement with the gear teeth 14.

Figure 22:
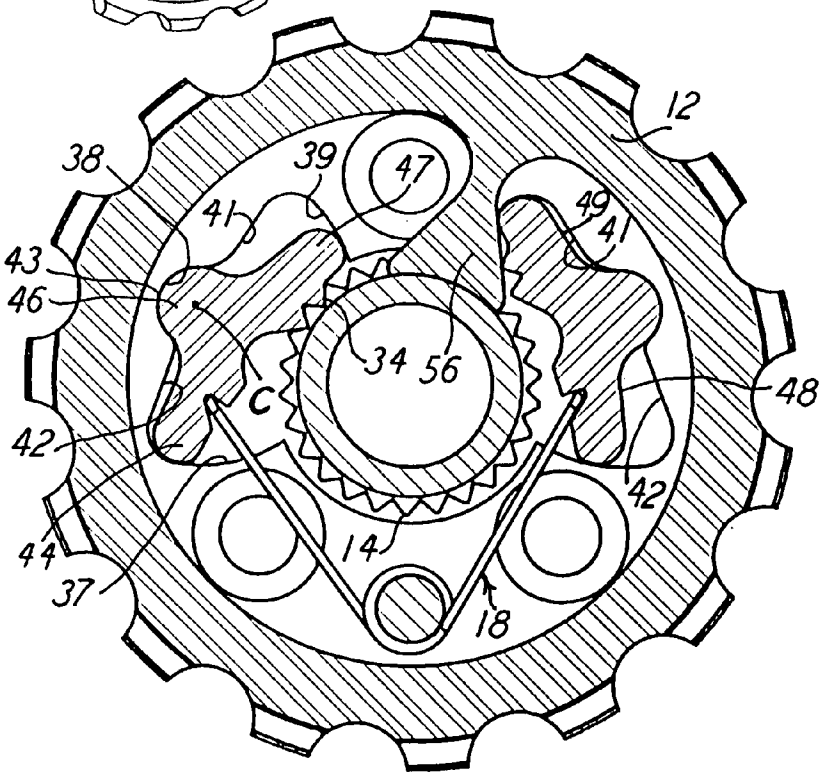
FIG. 22 is an enlarged view of FIG. 7 but with the bit removed.

As viewed along the axis A, the tooth engagement locations 34 are at the respective 10/11 o'clock and 1/2 o'clock locations, as seen in FIG. 12. The pawl pockets 27 and 28, as best seen in FIGS. 3 and 22, are defined in part by arcuate walls 37 and 38, both of which face the locations 34. The pockets 27 and 28 also have arcuate walls 39, and there are walls 41 and 42 in the formation of the pockets 27 and 28. An imaginary respective straight line between a point on each wall 37 and 38 and to the location 34 is substantially tangential to the gear teeth 14. Each pawl is shown to have at least two teeth disposed on the location 34 and engaged with two or three, gear teeth 14.

Figure 9:
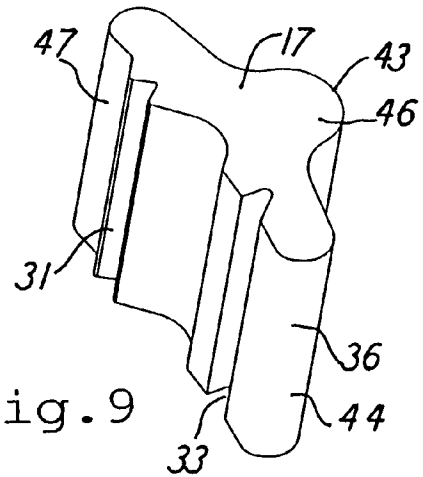
FIG. 9 is an enlarged perspective view of an embodiment of the pawl as seen in FIG. 2.
Figure 14:
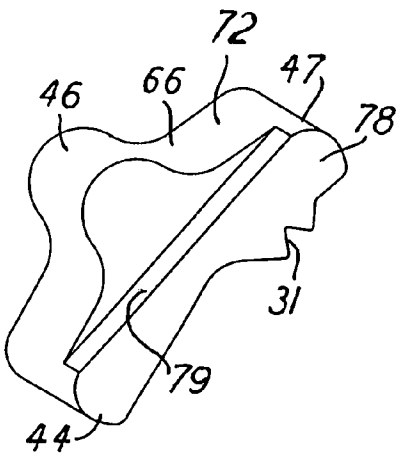
FIG. 14 is an enlarged perspective view of another embodiment of the pawl as seen in FIG. 13.
Figure 15:
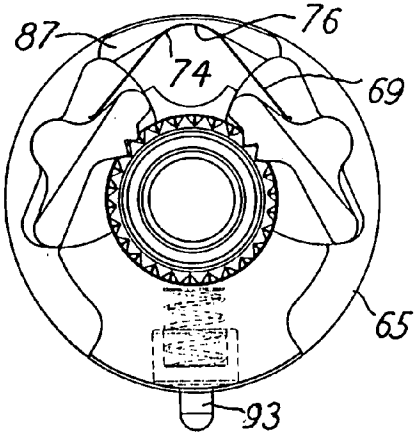
FIG. 15 is an end elevation view of FIG. 13.

The pawls have an exterior shape which complies with the shapes of the pockets 27 and 28 in all embodiments. It will be seen that the shape of the pawls is T-shaped in the end view as seen in FIGS. 7 and 15 which show the two respective embodiments of the T-shaped pawls of FIGS. 9 and 14. The pawls are confined relative to the radially direction of the axis A in a respective one of the pockets 27 and 28. The pawls each have an arcuate convex surface 43 which is in semi-circular sliding contact with the insert convex surface 38. The pawls, as shown in FIG. 7, are mirror images of each other, and they are respectively pivotally supported in the pockets 27 and 28.

The pawls have three semi-circularly shaped lobes 44, 46, and 47 that present the T-shape in the axial view, and those lobes are respectively disposed on, and can slide along, the walls 37, 38, and 39, respectively. In the pivoting action of the pawls, the lobe 46 acts as a fulcrum for the pawls which therefore pivot about the lobe 46 for gear engagement and disengagement. The center of the semi-circular configuration of the lobe 46 is shown at C, and that is also the center for the arcs 37, 38, and 39.

For the ratcheting mode, assuming clockwise driving rotation as view in FIGS. 3 and 22, the user's hand applies torque onto the handle 11, and that torque is presented at the surfaces or walls 37 and 38 of the pawl pocket 27. In turn, that force is transferred to the pawl lobes 44 and 46 and through the pawl 16 and onto the gear teeth 14 for the desired clockwise rotation of the insert 13 and thus also to the bit B. Those two circumferential torque forces on lobes 44 and 46 tend to position the pawl 16 in firm tooth-engaged contact with the gear 14. Also, the insert arcuate wall 39 is available to preclude over-movement of the pawl 16 beyond firm tooth engagement. Among the three contacts, namely, the contacts at the lobes 44 and 46 and the tooth-engaged location at 34, the pawl 16 is firmly held in tooth engagement. The lobes 44 and 46 are respectively engaged with the walls 37 and 38 by having their convex surfaces in respective sliding contact with the concave surfaces 37 and 38. Also, the pawl convex surface at the lobe 47 can be in sliding contact with the insert concave surface 39. Then, with the tooth engaged location, that forms a triangle of force transmission and stability with the lobes 44 and 46.

As best seen in FIG. 22, the pawls have recessed surfaces 48 and 49 disposed respectively between the lobes, and the surfaces 41 and 42 of the pockets 27 and 28 are disposed to be spaced from those lobes so there is no contact at those recessed surfaces even when the pawls are in the full engaged position and full disengaged position.

The cap 12 is suitably limitedly or restrictively rotatably attached to the handle on the insert 26, and the cap may be in any conventional attachment arrangement, such as the bayonet type shown where the flanges 51 interengage in the conventional manner to axially fix the cap relative to the handle but allow rotational movement of the cap to rotate slightly. Also conventionally, the cap 12 is releasably retained in any one of three rotated positions for determining the ratcheting and drive directions. Those positions are established by the post 23 which is yieldingly urged axially leftward in FIG. 1 by spring 52 to sequentially seat the post 23 into a selected one of the three holes 53 in the cap 12. That adjustment is simply a self-releasing over-ride arrangement so the cap can be rotated over the post 23 among the three positions.

Figure 19:
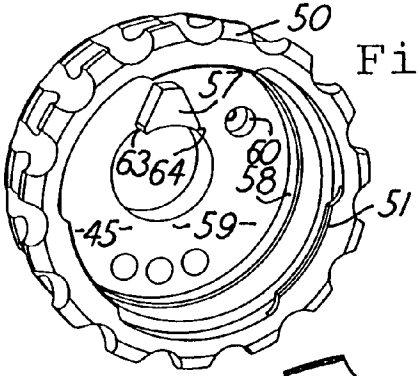
FIG. 19 is a perspective view of a cap of another embodiment of this invention.

The cap 12, and a somewhat different cap 50 of the FIG. 19 embodiment, are also attached relative to the handle for limited rotation in either direction. In those two embodiments, the rotation of the caps are limited by the pawls 16 and 17 which are axially positioned to interfere with rotation of those two caps. The pawl 16 is urged in the caps 12 and 50 by a spring 54 seen in FIG. 1. In that arrangement, the pawls 16 and 17 can be of different lengths, and the pawl 17 is shown in FIG. 2 to be longer and it fully occupies the length, or depth, of its pocket 28 and extends therebeyond, as seen in FIGS. 4 and 5. However, the pawl 16 can be of a shorter length and does not fully occupy the axial length of its pocket 27 which accommodates the spring 54, and, under the urging of the spring 54, pawl 16 extends beyond the length of the gear teeth 14 as does the pawl 17. In assembly, the caps 12 and 50 are axially moved onto the insert 26 and the caps present, in both the embodiments being mentioned, a web that is disposed between the pawls. Those webs are aligned with and force down on the spring-urged pawl 16, and, upon rotation of the caps 12 and 50 out of that alignment, the pawl 16 is released and the respective webs are rotated to a position between the pawls 16 and 17 which are then in the arcuate path of rotation of the webs to thereby preclude over-rotation of the caps relative to the handle.

Figure 21:
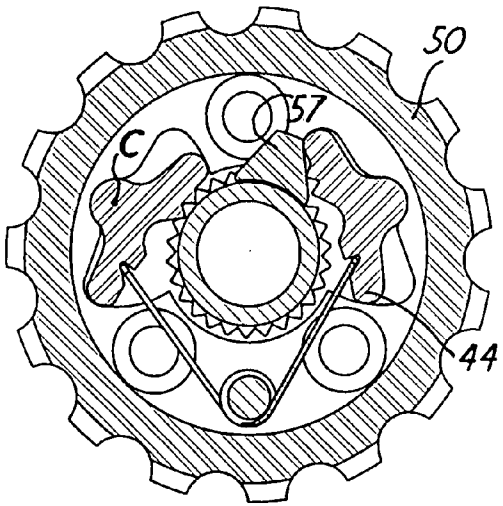
FIG. 21 is an enlarged view of FIG. 20, but with parts in positions different from those of FIG 20.
Figure 23:
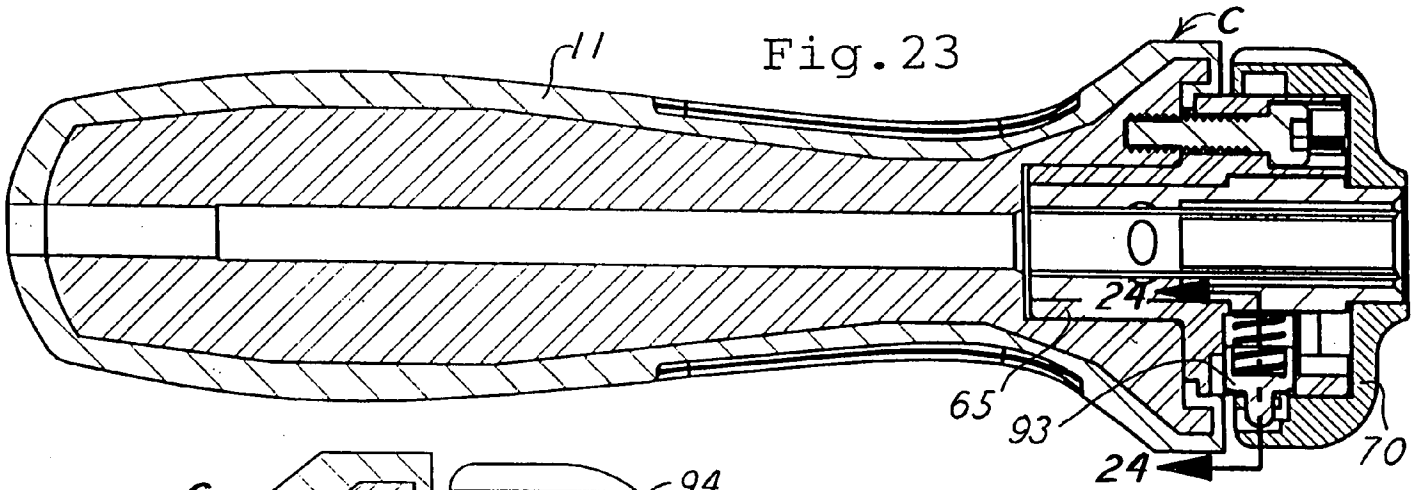
FIG. 23 is a longitudinal section view along the axis A and showing one embodiment of this invention.

In FIGS. 7–10, the cap 12 is shaped to present a bottom truncated pear-shaped web 56, and, in FIGS. 19–21, the cap presents a trapezoidal-shaped web 57. Those respective webs 56 and 57 extend radially inward from the cap rim 58, and that is formed by relieving the cap wall 59 of cap material, except for the webs 56 and 57. Thus there is the respective arcuate reliefs 45 along the walls 59. The web 56 extends under the arcuate lobe 47 with its respective ends 61 and 62. Likewise, the web 57 extends under the arcuate lobe 47 with it respective ends 63 and 64. Ends 61, 62, 63, and 64 are shown to present the largest width of the respective webs 56 and 57.

The webs 56 and 57 extend radially and fully to the shown and centrally and axially extending openings in the handle 11 and in the caps 12 and 50. The extent is to extend to locations between the pawls 16 and 17 and the webs are therefore positioned to pivot the pawls out of engagement with the gear teeth 14 and to restrict rotation of the cap when the respective web rotates toward either pawl which is in the rotation path of the webs, as both pawls are. FIGS. 7 and 21 show the respective pivoting and thus disengagement of the pawl 17 relative to the gear 13.

An access hole 60 in the cap 12 permits the insertion of an unshown pin into the cap and onto the pawl 16 to push the pawl 16 against the spring 54 and thereby permit the cap to be rotated beyond the pawl 16 and off the bayonet connection of the cap 12 with the handle 11 and its insert 26, for disassembly.

Figure 11:
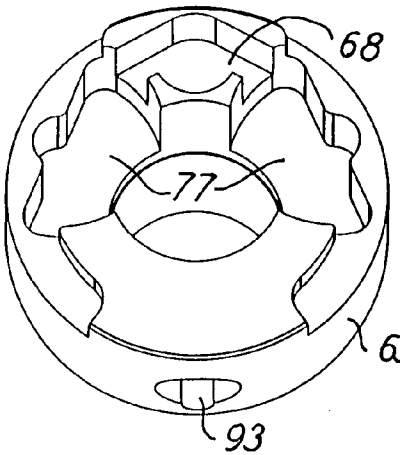
FIG. 11 is a perspective view of a handle part similar to FIG. 3, but of a different embodiment.
Figure 10:
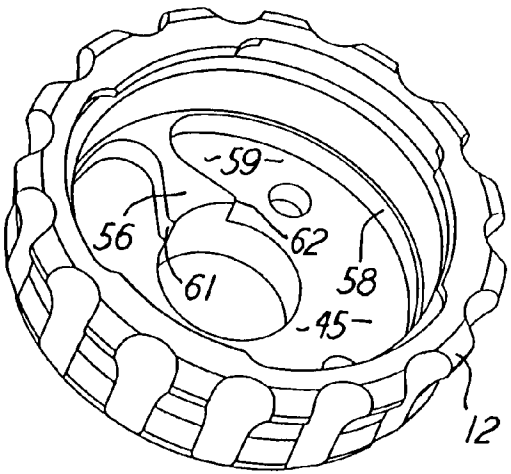
FIG. 10 is a perspective view of FIG. 8.

The embodiment of FIGS. 11–18 shows a somewhat different embodiment of the insert 26, now designated 65, and also of the cap 12, now designated 70, and the pawls, which are now pawls 66 and 67. The insert 65, as seen in FIGS. 11 and 15, has the spring-loaded pin 93 which mates with later described groove and holes in the cap interior for holding the cap onto in the insert. FIG. 11 shows there is a recess 68 which presents an inverted V-shape pocket 68, as it is shown. An inverted leaf spring 69 is supported in the pocket 68 and it has two legs 71 which respectively contact and slide on the shown convex tops 72 of the two pawls 66 and 67 through arcuate feet 73. The spring 69 and the insert 65 have mutually engaged arcuate portions 74 and 76 for positioning and guiding the spring 69, and thus the pocket 68 is a spring-receptive pocket.

Figure 13:
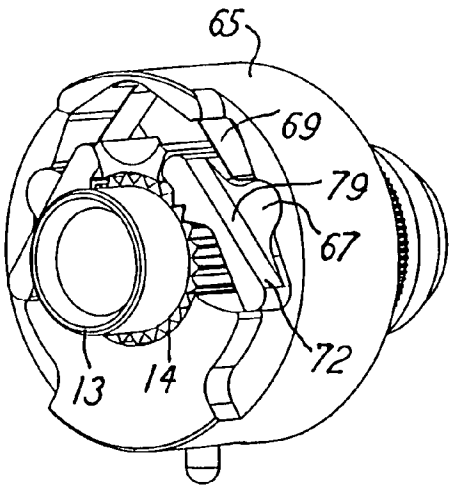
FIG. 13 is a perspective view of FIG. 12 with the can part removed.

That embodiment of the pawls 66 and 67 has the spring legs 71 in contact with the pawl surfaces 72 to pivotally urge the pawls 66 and 67 into tooth engagement with the gear teeth 14, as in FIGS. 12, 13, and 15. Also in this embodiment, the pawls 66 and 67 are of the same length, and they extend for the full length of the gear teeth 14.

The insert 65 of FIG. 11 has two T-shaped pockets 77 in substantially the upper half of the insert, and the pawls 66 and 67 are pivotally disposed in those two pockets. The pawls 66 and 67 of FIG. 14 are also T-shaped with the three lobes mentioned. A portion 78 of the pawls 66 and 67 extends beyond the respective pocket 77, and the pawls extend for the full length of the gear teeth 14. The pawls have an extended portion of a planar surface 79. The pawls 66 and 67 have the force-transmitting action and force reaction as previously described, so they are firm in the function of transmitting the torque applied through them. They have that triangle of force application, as shown and as mentioned above.

For the embodiment of FIGS. 11–18, the cap 12 is modified to become cap 70, and it has a central recess 81 at its end wall 82. That recess is substantially circular within the cap circular rim 83. Extending radially inward from the rim 83 are two substantially diametrically opposed webs 84 which can be integral with both the wall 82 and the rim 83. The webs 84 extend radially inward on the same transverse plane relative to the axis A, and they are shown to extend only a minor distance from the rim 83.

Figure 16:
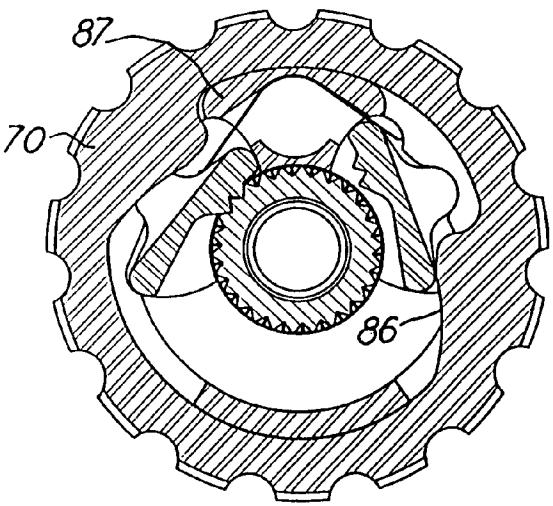
FIG. 16 is a section view like FIG. 12 but snowing the cap an pawl in respective positions different from those of FIG. 12.
Figure 17:
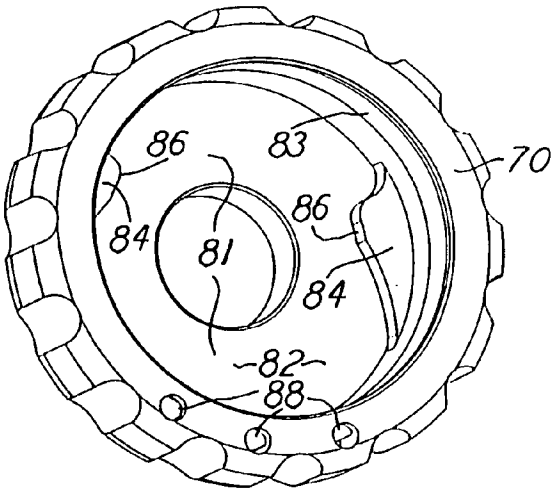
FIG. 17 is a perspective view of the can of FIGS. 2 and 16.

The webs 84 have radially inwardly facing arcuate surfaces 86 which radially align with the pawl surface 79. As such, the surfaces 79 and 86 are cam surfaces such that when the cap 70 is rotated clockwise, such as to the position shown in FIG. 16, the surface 86 slides on the pawl surface 79 to pivot pawl 67 to the shown position of disengagement from the gear teeth 14. In that maneuver where the cap 70 has been rotated clockwise, as seen in FIG. 16, and the drive is also clockwise. So the cap is rotated in the direction that the drive is achieved, and that is the same as with the previous embodiments, so the user knows the direction for the driving mode.

To limit the amount of cap rotation, the insert 65 has a protrusion 87, which, as seen in FIG. 16, is in interference location relative to the web 84 to thereby preclude further cap rotation in the clockwise direction. The cap 70 is releasably retained in one of three selected rotated positions, that is, for neutral, which is for drive in both rotation directions, and in clockwise and counterclockwise drive directions, and those are established by three holes 88 in the cap 70. A suitable spring-loaded pin, like the pin 23 but unshown and being on the insert 65, would engage one of the three holes 88 to set the cap 70 in that selected drive position.

The method of arranging the tool is disclosed in this description, and that includes the arrangement with the pawls and the spring 54 and the cap rotation and the positioning of the web between the pawls for cap rotation restriction. It also includes the release of the cap from its restricted rotation, all as described herein.

FIGS. 23–34 expand upon the previously described drawings, and they show an arrangement for releasably restraining the cap 70 on the screwdriver base assembly C which can be one or more of the handle 11 and of the insert 65 and of the gear shaft 13 or like cap-supportive members. While the handle 11, and also the pawls 66 and 67, can be the same as that previously described, the insert 65 and a detent or plunger member 93, along with the cap 70, are now described in greater detail. The function of orbiting the pawl mechanism about the axis A remains the same as before. Also, the cap 70 is restrained in both the rotational and the axial directions, as hereinafter described, but the bayonet or the like connection is not needed.

Of course the cap 70 can be rotated to a selected one of the plurality of the three shown positions for control of the pawl mechanism and thereby establish the direction of drive for the screwdriver. The pawl mechanism may consist of either one or two pawls, and may be of a conventional configuration. The only requirement is that the pawl mechanism be capable of selective drive intervention between the base assembly C and the bit B or the like, and the pawl mechanism, or other surfaces such as those shown in other views, may be, but not necessarily, in interference with the rotation of the cap 70, as described.

Figure 25:
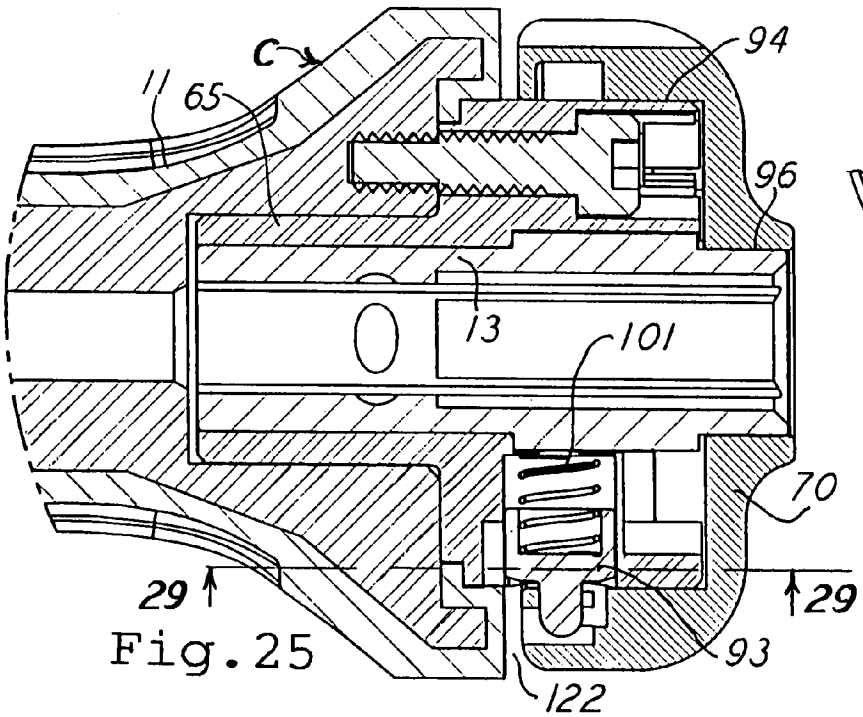
FIG. 25 is an enlarged view of a portion of FIG. 23.

The cap 70 is annular in overall shape and is rotatable on the base assembly C, specifically on the outer circumference 94 of the insert 65 and the outer circumference 96 of the gear shaft 13, as seen in FIG. 25. That is, the cap is piloted on the base assembly C by axially spaced-apart circular surfaces on both the interior of the cap 70 and the exterior of the supporting base assembly members, as mentioned. The cap is snug on the base assembly and in circular contact therewith, and is rotatable and stable thereon to avoid end-to-end rocking motion along axis A but yet be rotatable therearound.

Figure 26:
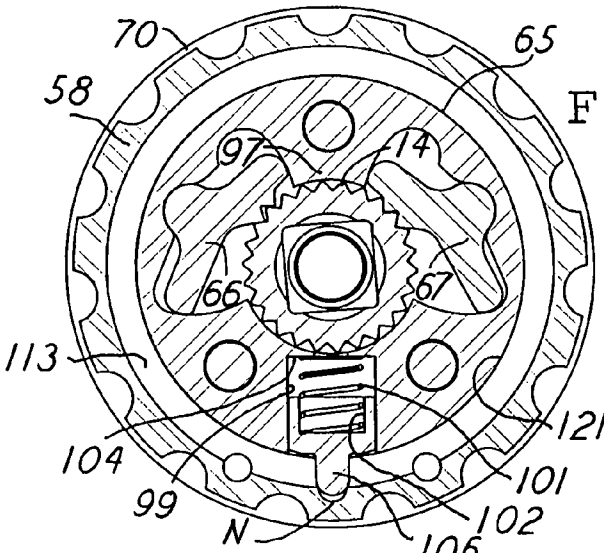
FIG. 26 is an enlarged section view taken on the plane similar to that for FIG. 24 off FIG. 23.

FIG. 26 shows that the cap 70 has its web 97 extending radially inwardly from the rim 58 of the cap 70 and it extends to the teeth 14 of the gear 13. Upon rotation of the cap 70, web 97 moves in a circular path of rotation to abut the pawls 66 and 67 and thereby disengage the selected pawl 66 or 67 from tooth engagement with the gear teeth 14. In that manner, the ratchet direction of the screwdriver is established. As shown elsewhere herein, there may be other configurations of the cap.

Figure 24:
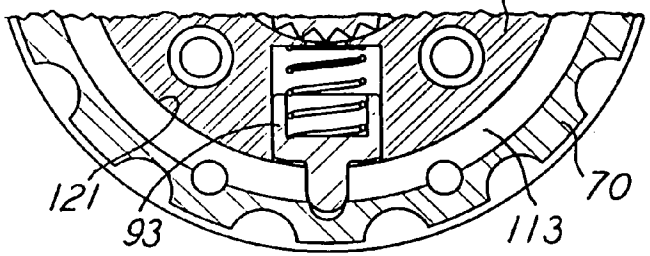
FIG. 24 is an enlarged section view taken on the plane designated by the line 24—24 in FIG. 23.
Figure 30:
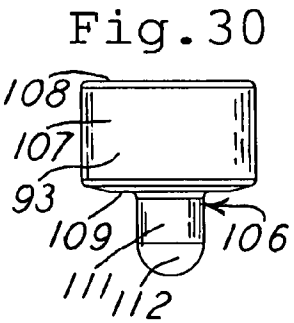
FIGS. 30 and 31 are enlarged side elevation and perspective views, respectively, of a sectioned part in FIG. 26.
Figure 31:
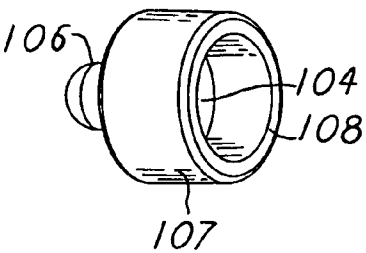
Figure 29:
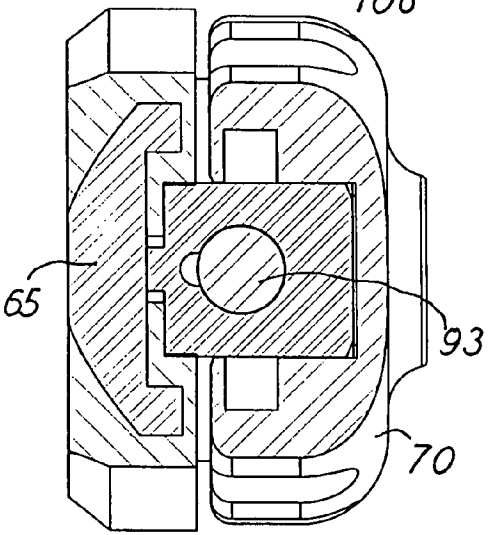
FIG. 29 is an enlarged section view taken on a plane designated by the line 29—29 in FIG. 25.
Figure 27:
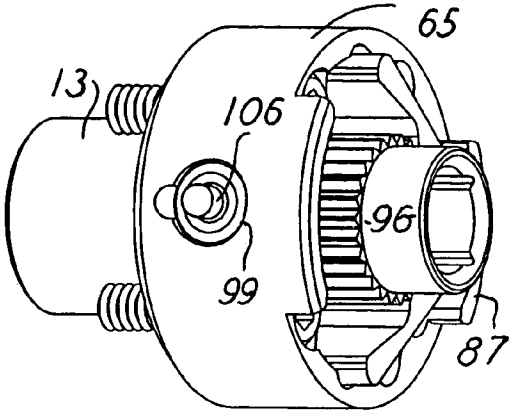
FIG. 27 is a perspective view of parts seen in FIG. 25.
Figure 28:
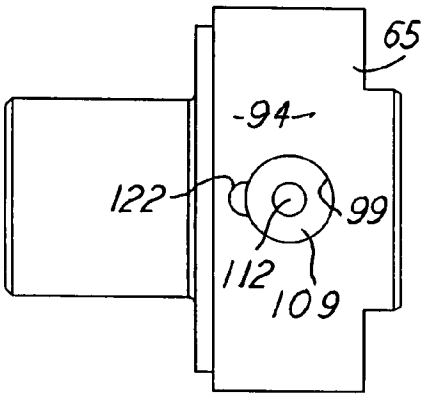
FIG. 28 is a bottom plan full view of parts of FIG. 25.

The insert 65 has a cylindrical pocket 99 extending radially therein for slideably receiving the detent 93, as seen in FIG. 24. A compression spring 101 yieldingly urges the detent 93 radially outwardly on the insert 65. There is a pocket 102 in the detent 93 for receiving the spring 101, and the insert has a support surface 104 for abutting the spring 101. Thus, the detent or plunger 93 extends and moves radially relative to the axis A, and it has an end 106 which extends beyond the insert 65, as seen in FIG. 26. The plunger 93 is shown to be cylindrical throughout its length from its top to its bottom, as seen in FIG. 30, and it is snug within but radially slideable in the insert pocket 99. One end 107 of the plunger 93 is a larger circular end, and the other end 106 is axially aligned with end 107 and is a smaller circular end. The enlarged end 107 terminates in planar surfaces 108 and 109.

The plunger end 106 includes a cylindrical portion 111 and a contiguous hemispherical or circular portion or tip 112. The cap 70 has a circular groove 113 extending on the cap inside and facing radially inwardly, such as seen in FIGS. 24 and 26. FIG. 33 shows that the groove 113 is defined by a bottom circular wall 114 and two side surfaces 116 and 117, with the latter two facing each other and axially. The plunger portion 111 is disposed in the groove 113, and the width and depth of the groove 113 are substantially the respective length and diameter of the plunger portion 111 so the portion 111 can be in sliding contact with the side wall 117. Thus, the plunger portion 111 is snugly within and slides in the groove 111 when the cap 70 is rotated about the axis A. The arrangement is such that the plunger 106 restricts the cap 70 in axial movement so the cap cannot be moved axially off the base assembly while the plunger 106 is in its shown extended position under the influence of the spring 101. So the plunger end 111 has planar extending sides extending along its cylindrical shape and being in contact with the groove wall 117.

The cap 70 also has three semi-circular openings 88, now designated R, L, and N. FIGS. 24 and 26 show the detent 106 in the neutral N position where the detent tip 112 is in that opening N. That releasably holds the cap 70 in that non-ratcheting position, as then selected and desired. The three openings and the portion 112 snugly mate and are of the same semi-circular or arcuate shape in the end views shown, so the detent is self-releasing from those three openings simply upon rotation of the cap 70 to where the detent can go into either opening R or L, for right or left drive of the screwdriver and for the ratchet action in the direction opposite to the R or L setting. That is, the openings R, N, and L are formed by drilling into the cap 70 from the axial end thereof and after the groove 113 is formed. Then those three openings intersect the groove in the finished cap. It is preferred that the holes R, N, and L first be formed in the cap, and then the groove 113 can be formed in the cap.

So, the cap surface 117 abuts the so-called planar or straight side of the detent portion 111 to restrict the axial movement of the cap 70 off the base assembly C.

If and when it is desired to limit overall rotation of a cap, in the one embodiment shown in FIG. 16, the insert protrusion 87 can interfere with the rotation of the cap, such as by engagement from the webs 84, the cap can not be rotated to where it will be released from other connections, such as the bayonet connection with the base assembly. So, if that is desired, rotation of the cap will be limited to the extent of achieving the selection of the three positions mentioned. Alternatively, the cap 70 can be limited in rotation by having the groove 113 itself limited in its arcuate extent, such as shown by the short groove 113A in FIG. 34. In that arrangement, the detent portion 111 is still in the groove 113A but the cap is limited in rotation by presenting groove end walls 118 and 119 which abut the detent portion 111 upon the then maximum rotation of the cap 70. So, again, the cap 70 is restrained to be within the desired limited rotational movement of the cap relative to the three cap positions available.

The entire arrangement is that the detent portion 111 is snug in the groove to thereby restrict axial movement of the cap 70, and the cap may also be restricted in total rotation on the base assembly C. In the embodiment seen in FIG. 34, the detent provides that third restriction and that is that the rotation of the cap is limited by the end walls 118 and 119. In the several arrangements disclosed as to this third restriction, they may be omitted and only the two previously mentioned restrictions may be applied. Also, the detent 93 is an intervening member which is operative between the base assembly and the particular cap mounted thereon.

As shown in FIGS. 24 and 33, the detent portion 106 has its end wall 109 in abutment with the circular surface 121 on the cap 70 to thereby restrict the detent radially inwardly on the base assembly but have the detent extend radially outwardly to be in the groove 113.

To release the cap from the base assembly C, the detent 93 can be depressed against the spring 101 to where the detent portion 106 is moved out of the groove. For that function, there is an access opening 122 in the screwdriver, and there can be a tool (unshown) of any narrow configuration and which the user can maneuver to fit into the opening 122 for pushing the detent out of the groove and thereby release the cap from the base assembly C. Of course reassembly can be achieved by simply sliding the cap onto the base assembly and have the detent retract radially to clear the edge 123 of the cap. So the cap 70 is released from the base assembly by arranging for, and effecting, depressing the detent 93 out of the cap groove.

Again, the method of providing and using the screwdriver is described herein and it will be understood that the provisions for the detent and the cap groove are achieved, and the assembly and release of the cap is also achieved, as explained herein. Three functions of the detent 93 are also disclosed.

It should be understood that the detent, which is the intervening member 93, can be on either the base assembly C or one of the several caps disclosed herein. Then the groove 113 or 113 A can be on the other portion of the screwdriver. Of course, in all instances, the detent will slide in the groove to restrain the cap in the axial direction and preclude removal of the cap from the base assembly until the detent is released. The detent is preferably spring urged into the retaining position, and it is accessible for movement either toward or away from the axis A and thus into its released position. That is, mere reversal of parts from that shown herein, is within the scope of this invention. The essence is that the detent restrains the cap against axial movement and it can also be employed to restrain the cap against rotational movement in certain arrangements herein. There may or may not be an additional restraint, that is one whereby the cap is limited in its rotational movement about the axis A, such as by the stop 87 or the pawls themselves, or the stops in the groove itself, as shown.

What is claimed is:

1. In a screwdriver with ratchet mechanism and including a base assembly having a longitudinal axis, a gear rotatably supported in said base assembly on said axis, pawl mechanism movably disposed on and being included in said base assembly for selective drive engagement with said gear and said base assembly, and an annular cap releasably connected with said base assembly and aligned on said axis and being rotatable on said base assembly about said axis and being arranged for disengaging said pawl mechanism from said gear upon rotation of said cap about said axis and being movable off said base member in a direction parallel to said axis, the improvement comprising:

said base assembly and said cap respectively supporting a first set of mutually and releasably engageable contacting surfaces in contact with each other in a circular direction about said axis for limiting the rotation of said cap about said axis, said cap having a groove facing said axis and arcuately extending centered to said axis, an intervening member operatively interposed between said base assembly and said cap and extending into said groove and with said intervening member and said cap supporting a second set of mutually and releasably engageable contacting surfaces in contact with each other in said groove in the direction parallel to said axis for restraining said cap against removal from said base assembly, and said intervening member and said cap supporting a third set of mutually and releasably engageable contacting surfaces contiguous with said groove and in contact with each other in a circular direction centered to said axis for selective rotational releasable restraint of said cap on said base assembly in at least two rotated positions of said cap.

2. The screwdriver with ratchet mechanism as claimed in claim 1, including:

a spring disposed between said base assembly and said intervening member for releasably positioning said intervening member engaged between said base assembly and said cap.

3. The screwdriver with ratchet mechanism as claimed in claim 2, including:

said screwdriver having an access opening extending into communication with said intervening member for facilitating moving said intervening member against said spring and thereby release said intervening member from engagement relative to said cap.

4. The screwdriver with ratchet mechanism as claimed in claim 3, wherein:

said access opening is a space between said cap and said base assembly.

5. The screwdriver with ratchet mechanism as claimed in claim 1, wherein:

said first set of said contacting surfaces includes a surface on said pawl mechanism.

6. The screwdriver with ratchet mechanism as claimed in claim 1, wherein:

said cap is rotationally snugly piloted on said base assembly by having circular surfaces spaced apart in the axial direction along said cap for stability of said cap on said base assembly.

7. In a screwdriver with ratchet mechanism and including a base assembly having a longitudinal axis, a gear rotatably supported in said base assembly on said axis, pawl mechanism movably disposed on said base assembly for selective drive engagement with said gear and said base assembly, and an annular cap releasably connected with said base assembly and aligned on said axis and being rotatable thereon about said axis and being arranged for disengaging said pawl mechanism from said gear upon rotation of said cap about said axis, the improvement comprising:

said cap having two spaced-apart planar walls disposed transverse to said axis and thereby defining a groove between said walls and with said groove facing and extending centered on said axis in an arcuate configuration, a member disposed in said groove and movable radial to said axis and being operatively interposed between said base assembly and said cap and respectively presenting with said base assembly a first set of mutually and releasably engageable contacting surfaces in contact with each other at said walls and being disposed in a direction facing parallel to said axis for releasably restraining said cap in said parallel direction and relative to said base assembly, and said movable member and said base assembly presenting a second set of mutual and releasably engageable contacting surfaces in contact with each other in a circular direction about said axis for selective rotational releasable restraint of said cap relative to said base assembly in at least two rotated positions of said cap.

8. The screwdriver with ratchet mechanism as claimed in claim 7, including:

a spring between said base assembly and said movable member for releasably positioning said movable member into engagement between said base assembly and said cap.

9. The screwdriver with ratchet mechanism as claimed in claim 8, including:

said screwdriver having an access opening extending into communication with said movable member for facilitating moving said movable member against said spring and thereby release said movable member from engagement relative to said cap.

10. The screwdriver with ratchet mechanism as claimed in claim 9, wherein:

said access opening is a space between said cap and said base assembly.

11. The screwdriver with ratchet mechanism as claimed in claim 7, wherein:

said cap is rotationally snugly piloted on said base assembly with annular pilot surfaces spaced apart in the axial direction along said cap.

12. In a screwdriver with ratchet mechanism and including a base assembly having a longitudinal axis, a gear rotatably supported in said base assembly on said axis, pawl mechanism movably disposed on said base assembly for selective drive engagement with said gear and said base assembly, and an annular cap releasably connected with said base assembly and aligned on said axis and being rotatable on said base assembly about said axis and being arranged for disengaging said pawl mechanism from said gear upon rotation of said cap about said axis and being movable off said base assembly in a direction parallel to said axis, the improvement comprising:

said cap having a groove facing radially inwardly toward said base assembly, a slideable member on said base assembly and movable radially to said axis and being operatively interposed between said base assembly and said cap and extending into said groove for restraining said cap against movement off said base assembly and in the direction parallel to said axis, said cap having pockets spaced circularly around said cap and intersecting said groove, and said slideable member selectively extending into and out of said pockets upon rotation of said cap on said base assembly for selective rotational releasable restraint of said cap on said base assembly and about said axis in at least two rotated positions of said cap.

13. The screwdriver with ratchet mechanism as claimed in claim 12, including:

a spring between said base assembly and said slideable member for releasably holding said slideable member in engagement between said base assembly and said cap.

14. The screwdriver with ratchet mechanism as claimed in claim 13, including:

said screwdriver having an access opening extending into communication with said slideable member for facilitating moving said slideable member against said spring and out of said pockets and thereby release said slideable member from engagement relative to said cap.

15. The screwdriver with ratchet mechanism as claimed in claim 14, wherein:

said access opening is a space between said cap and said base assembly.

16. The screwdriver with ratchet mechanism as claimed in claim 12, wherein:

said cap is rotationally snugly piloted on said base assembly with annular surfaces spaced apart in the axial direction along said cap.

17. The screwdriver with ratchet mechanism as claimed in claim 12, wherein:

said groove is defined by two spaced-apart end walls for presenting a limited length to said groove and two spaced-apart rotation stops for said cap.

18. In a screwdriver with ratchet mechanism and including a base assembly having a longitudinal axis, a gear rotatably supported in said base assembly on said axis, pawl mechanism movably disposed on said base assembly for selective drive engagement with said gear and said base assembly, and an annular cap releasably connected with said base assembly and aligned on said axis and being rotatable on said base assembly about said axis and being arranged for disengaging said pawl mechanism from said gear upon rotation of said cap about said axis and being movable off said base assembly in a direction parallel to said axis, the improvement comprising:

one of said cap and said base assembly having a groove facing radially relative to said axis, a slideable member operatively interposed between said base assembly and said cap and extending into said groove for restraining said cap against movement off said base assembly in the direction parallel to said axis, one of said cap and said base assembly having a plurality of pockets spaced circularly around said axis and intersecting said groove, and said slideable member selectively movable into and out of said pockets upon rotation of said cap on said base assembly for selective rotational releasable restraint of said cap on said base assembly and about said axis in at least two rotated positions of said cap on said base assembly.

19. The screwdriver with ratchet mechanism as claimed in claim 18, including:

a spring between said base assembly and said slideable member for releasably positioning said slideable member in said pockets.

20. The screwdriver with ratchet mechanism as claimed in claim 19, including:

said screwdriver having an access opening extending into communication with said slideable member for facilitating moving said slideable member against said spring and out of said pockets and thereby release said slideable member from restraining said cap from movement off said base assembly.

21. The screwdriver with ratchet mechanism as claimed in claim 20, wherein:

said access opening is a space between said cap and said base assembly.

22. The screwdriver with ratchet mechanism as claimed in claim 18, wherein:

said cap is rotationally snugly piloted on said base assembly with annular surfaces spaced apart in the axial direction along said cap.

23. The screwdriver with ratchet mechanism as claimed in claim 18, including:

a spring operative on said slideable member for urging said slideable member into said groove, and said slideable member being accessible from the exterior of said screwdriver for accessing said slideable member and thus facilitate movement of said slideable member out of said groove and thereby release said cap from both rotational and axial movement restraint relative to said base assembly.

24. The screwdriver with ratchet mechanism as claimed in claim 18, including:

and said cap and said base assembly having mutually contacting surfaces, in addition to said slideable member, for limiting relative rotation of said cap on said base assembly.

25. The screwdriver with ratchet mechanism as claimed in claim 18, including:

said slideable member and said groove having planar surfaces in contact with each other for the restraining of said cap against movement off said base assembly, and said slideable member and one of said base assembly and said cap having arcuate surfaces in contact with each other at said pockets for the rotational restraint of said cap on said base assembly.

26. The screwdriver with ratchet mechanism as claimed in claim 18, including:

a portion of said slideable member being movable into said pockets and said portion and said pockets being arcuate in configuration for self release from each other upon rotation of said cap on said base assembly.

27. The screwdriver with ratchet mechanism as claimed in claim 18, wherein:

said groove is defined by two spaced-apart end walls for presenting a limited length to said groove and two spaced-apart rotation stops for said cap.

28. In a screwdriver with ratchet mechanism and including a base assembly having a longitudinal axis, a gear rotatably supported in said base assembly on said axis, pawl mechanism movably disposed on said base assembly for selective drive engagement with said gear and said base assembly, and an annular cap releasably connected with said base assembly and aligned on said axis and being rotatable thereon about said axis and being arranged for disengaging said pawl mechanism from said gear upon rotation of said cap about said axis, the improvement comprising:

a member movable radial to said axis and being operatively interposed between said base assembly and said cap and respectively presenting with said cap a first set of mutually and releasably engageable contacting surfaces in contact with each other in a direction parallel to said axis for releasably restraining said cap in said parallel direction and relative to said base assembly, and said movable member and said cap presenting a second set of mutual engageable contacting surfaces in contact with each other in a circular direction about said axis for selective rotational restraint of said cap relative to said base assembly and about said axis.

29. The screwdriver with ratchet mechanism as claimed in claim 28, further comprising:

said cap having a circular groove therein for presenting at least one of said contacting surfaces in said cap first set of contacting surfaces, and said cap having circularly spaced-apart walls defining end limits of said groove for abutment with said movable member for limiting rotation of said cap on said base assembly.

30. The screwdriver with ratchet mechanism as claimed in claim 29, further comprising:

a spring between said base assembly and said movable member for releasably holding said movable member in engagement between said base assembly and said cap, and said screwdriver having an access opening between said base assembly and said cap and extending into communication with said movable member for facilitating moving said movable member against said spring and thereby release said movable member from engagement relative to said cap.

* * * * *